US010953405B2

(12) United States Patent
Hedlund et al.

(10) Patent No.: US 10,953,405 B2
(45) Date of Patent: Mar. 23, 2021

(54) BLADE ELEMENT

(71) Applicant: Valmet Technologies Oy, Espoo (FI)

(72) Inventors: Christer Hedlund, Espoo (FI); Dino Muhic, Espoo (FI); Petteri Vuorio, Espoo (FI); Anders Hawen, Espoo (FI)

(73) Assignee: Valmet Technologies, Inc., Espoo (FI)

( * ) Notice: Subject to any disclaimer, the term of this patent is extended or adjusted under 35 U.S.C. 154(b) by 468 days.

(21) Appl. No.: 15/579,872

(22) PCT Filed: Jun. 6, 2016

(86) PCT No.: PCT/FI2016/050401
§ 371 (c)(1),
(2) Date: Dec. 5, 2017

(87) PCT Pub. No.: WO2016/198743
PCT Pub. Date: Dec. 15, 2016

(65) Prior Publication Data

US 2018/0154366 A1 Jun. 7, 2018

(30) Foreign Application Priority Data

Jun. 11, 2015 (FI) ..... 20155448
Jun. 11, 2015 (FI) ..... 20155449

(51) Int. Cl.
*B02C 7/12* (2006.01)
*D21D 1/30* (2006.01)

(52) U.S. Cl.
CPC ..... *B02C 7/12* (2013.01); *D21D 1/306* (2013.01)

(58) Field of Classification Search
CPC ..... D21D 1/006; D21D 1/008; D21D 1/303; D21D 1/30; D21D 1/306; B02C 7/12
See application file for complete search history.

(56) References Cited

U.S. PATENT DOCUMENTS 35,858 A * 7/1862 Sedgebeer ..... B02C 7/12 241/296
4,023,737 A * 5/1977 Leider ..... B02C 7/12 241/261.3

(Continued)

FOREIGN PATENT DOCUMENTS

WO WO-2004078355 A1 * 9/2004 ..... D21D 1/306
WO 2004110628 A1 12/2004

OTHER PUBLICATIONS

International Search Report for PCT/FI2016/050401 dated Oct. 7, 2016.

(Continued)

*Primary Examiner* — Adam J Eiseman
*Assistant Examiner* — Stephen Floyd London
(74) *Attorney, Agent, or Firm* — Stiennon & Stiennon

(57) ABSTRACT

A blade element (1) for a refiner for refining fibrous material comprises a refining surface (3) provided with blade bars (8, 10) and blade grooves (9, 11) there-between. The blade bars (8, 10) have side walls (8", 8''') facing away from one another. The side walls (8", 8''') of the at least one blade bar (8) comprise on both of its side walls (8", 8''') steps (14", 14''') which extend at least partly in the transversal direction relative to the side walls (8", 8''') of the blade bar (8) and away from one another.

13 Claims, 5 Drawing Sheets

(56) References Cited

U.S. PATENT DOCUMENTS 4,269,362 A * 5/1981 Berggren ..... B01F 7/00758 241/28
5,249,734 A * 10/1993 Pilao ..... B02C 7/12 228/182
6,311,907 B1 11/2001 Gingras
6,325,308 B1 * 12/2001 Lofgren ..... D21D 1/306 241/28
6,616,078 B1 * 9/2003 Gingras ..... B02C 7/12 241/261.2
7,900,862 B2 3/2011 Gingras
10,130,953 B1 * 11/2018 Ranne ..... B02C 17/163
2005/0194482 A1 * 9/2005 Cassidy ..... D21B 1/32 241/220
2006/0151648 A1 * 7/2006 Vuorio ..... B02C 7/12 241/261.2
2008/0191078 A1 * 8/2008 Gingras ..... D21D 1/306 241/298
2010/0269991 A1 * 10/2010 Antensteiner ..... D21D 1/008 162/55
2010/0314476 A1 * 12/2010 Vuorio ..... B02C 7/12 241/101.2
2011/0278385 A1 * 11/2011 Fursattel ..... D21D 1/24 241/30
2012/0006924 A1 1/2012 Ruola
2013/0015281 A1 1/2013 Gingras
2015/0040946 A1 * 2/2015 Hofmann ..... B29B 17/02 134/10
2017/0072402 A1 * 3/2017 Aitken ..... B02C 7/12
2018/0345291 A1 * 12/2018 Knight ..... B02C 7/04

OTHER PUBLICATIONS

Written Opinion of the International Searching Authority for PCT/FI2016/050401 dated Oct. 7, 2016.
European Search Report for PCT/FI2016/050401 dated Jan. 31, 2019.

* cited by examiner

BLADE ELEMENT

CROSS REFERENCES TO RELATED APPLICATIONS

This a national stage application of FI2016050401 filed on Jun. 6, 2016 and claims priority from FI 20155448 filed on Jun. 11, 2015, and FI20155449 filed on Jun. 11, 2015 each of which are included by reference in their entirety.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a blade element for a refiner for refining fibrous material, the blade element comprising a refining surface provided with blade bars and blade grooves therebetween, the blade bars extending in a direction from an inner edge of the blade element toward an outer edge of the blade element and having side walls facing away from one another.

Refiners used for manufacturing mechanical pulp are typically formed of two refining elements opposite to each other and turning relative to each other, i.e. one or both of them is/are rotating. The refining elements comprise refining surfaces provided with blade bars and blade grooves therebetween, the blade bars being intended to defiber and refine the material to be refined and the blade grooves being intended to convey the material to be refined forward along the refining surfaces.

The refining surfaces of the refining elements are typically formed by blade elements comprising the blade bars and the blade grooves, whereby the refining surface of the refining element is implemented by a single blade element intended to provide a complete refining surface of the refining element or by several blade elements, also called blade segments, which together provide the complete refining surface when the individual blade elements are fastened to the refining element next to each other.

WO-publication 2004/110628 discloses a refining surface provided with blade bars and blade groves therebetween. The blade bars are formed of at least two different blade bar parts connected to each other such that one of the blade bar parts is farther ahead in the intended rotation direction of the refining surface than the other blade bar part, and the wall of the side of the intended rotation direction of the refining surface is at least in some blade bar parts over at least part of its length substantially inclined. The inclined side wall of the blade bar causes the material to be refined to move more efficiently out of the blade grooves up to a blade gap between the opposite refining surfaces. The inclined side wall has thus an effect similar to that of a dam remaining at a bottom of a blade groove between neighboring blade bars but without a tendency of causing the blade groove becoming clogged of the material to be refined.

SUMMARY OF THE INVENTION

An object of the present invention is to provide a novel blade bar construction for a refiner.

The blade element according to the invention is characterized in that the blade element comprises at least one blade bar comprising in a longitudinal direction thereof at least two successive blade bar parts connected to each other and that the side walls of the at least one blade bar comprise at a connecting point of the two successive blade bar parts steps which extend to at least partly transversal direction relative to the side walls of the blade bar and away from one another.

An advantage of the blade element being provided with blade bars having steps on both of its side walls is that a rotatable refining element of the refiner provided with the blade element comprising blade bars as disclosed may be rotated into both directions.

Some embodiments of the invention are disclosed in the dependent claims.

BRIEF DESCRIPTION OF THE DRAWINGS

In the following the invention will be described in greater detail by means of preferred embodiments with reference to the accompanying drawings, in which.

For the sake of clarity, the figures show some embodiments of the invention in a simplified manner. Like reference numerals identify like elements in the figures.

DESCRIPTION OF THE PREFERRED EMBODIMENTS

Figure 1:
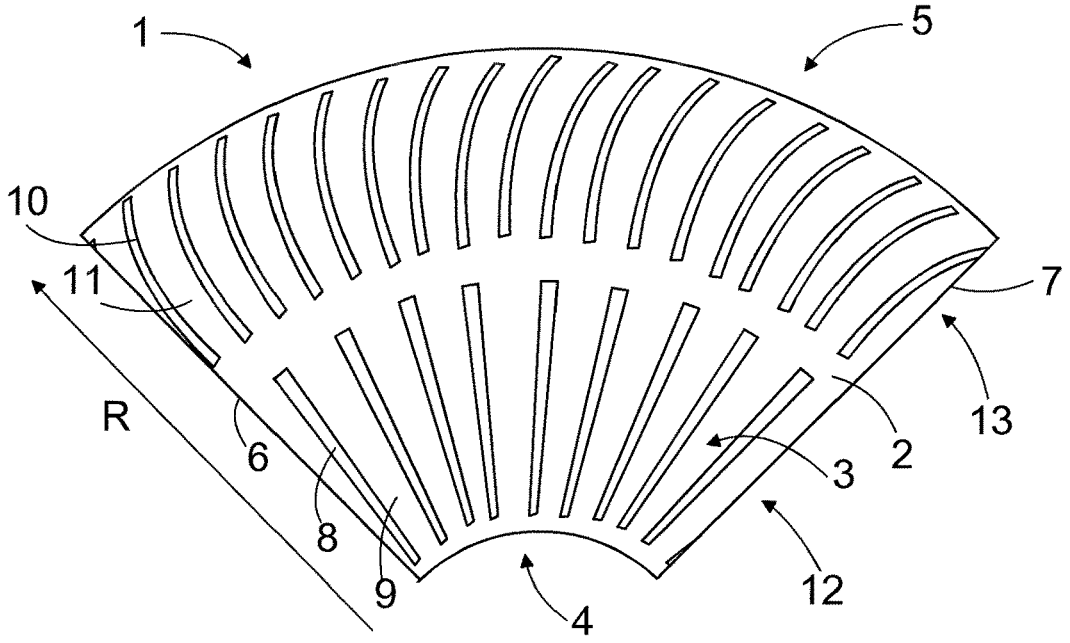
FIG. 1 is a general upper view of a blade element.

FIG. 1 is a schematic general upper view of a blade element 1. The blade element 1 of FIG. 1 is a disc-like blade segment intended to provide a part of a refining surface of a refining element in a disc refiner intended for refining fibrous material, such as wood material. The blade element 1 of FIG. 1 comprises a blade element body 2 and a refining surface 3 on an upper surface thereof. The blade element 1 comprises an inner edge 4 or a feed edge 4 or an inner periphery 4 which is directed toward a center of the disc refiner and through which the material to be refined may be fed into a blade gap between opposing refining elements. The blade element 1 further comprises an outer edge 5 or a discharge edge 5 or an outer periphery 5 through which the material already refined in the blade gap between the opposing refining elements may be discharged out of the blade gap, as well as a first side edge 6 and a second side edge 7 providing the side edges of the blade element 1 of FIG. 1.

Next to the inner periphery 4 of the blade element 1 the refining surface 3 is provided with blade bars 8 and blade grooves 9 therebetween, i.e. with first blade bars 8 and first blade grooves 9 therebetween. Next to the outer periphery 5 of the blade element 1 the refining surface 3 is provided with other blade bars 10 and other blade grooves 11 therebetween. The blade bars 8 and the blade grooves 9 next to the inner periphery 4 of the blade element 1 provide a defibration zone 12 intended to disintegrate woods chips fed into the refiner to individual fibers. The blade bars 10 and the blade grooves 11 next to the outer periphery 5 of the blade element 1 provide a refining zone 13 that is successive to the defibration zone 12 in an intended flow direction of the material to be processed, or in a direction of a radius R of the blade element 1, the radius R extending from the inner periphery 4 up to the outer periphery 5 and disclosed schematically with an arrow R. The refining zone 13 is intended to refine the material to be processed, i.e. fibrillation and fiber shortening of the material to be processed is intended to take place at this zone of the blade element 1.

Differing from the embodiment of FIG. 1 at least some of the blade bars 8 remaining in the defibration zone 12 may also extend to the refining zone 13.

Alternatively to the embodiment of the blade element of FIG. 1, a blade element may be intended to provide a part of only a single zone in a refining element having multiple zones, whereby the refining element may comprise several neighboring blade elements both in a direction of the radius of the refining element and in a peripheral direction of the refining element. In that case the defibration zone 12 and the refining zone 13 could lie on separate blade elements so that the defibration zone 12 alone could provide a radially inner element and, respectively, the refining zone 13 could form a radially outer element.

Figure 3:
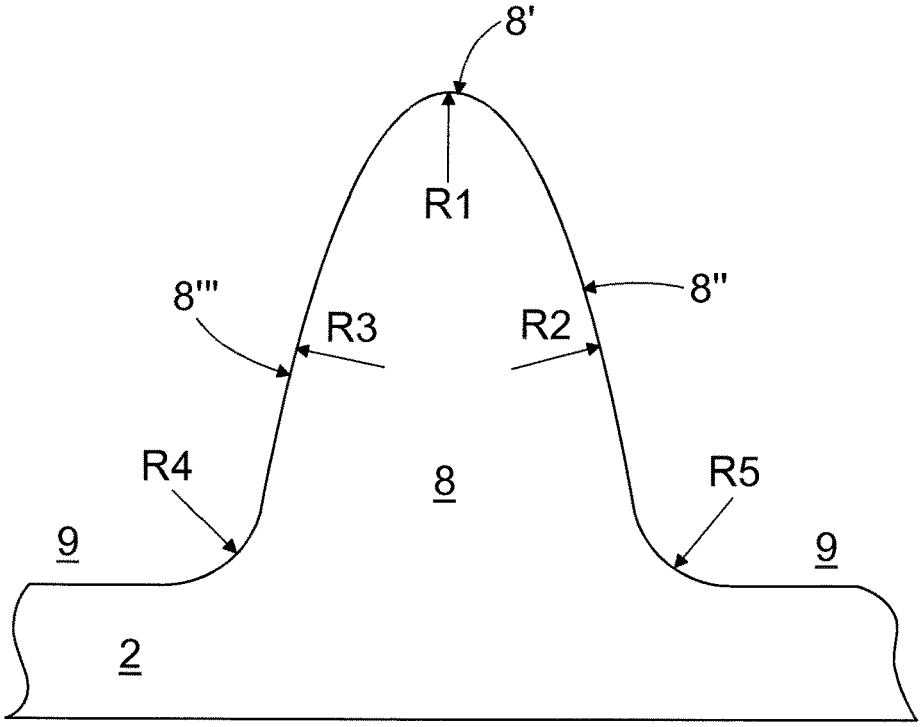
FIG. 3 is a schematic front view of the blade bar of FIG. 2.
Figure 2:
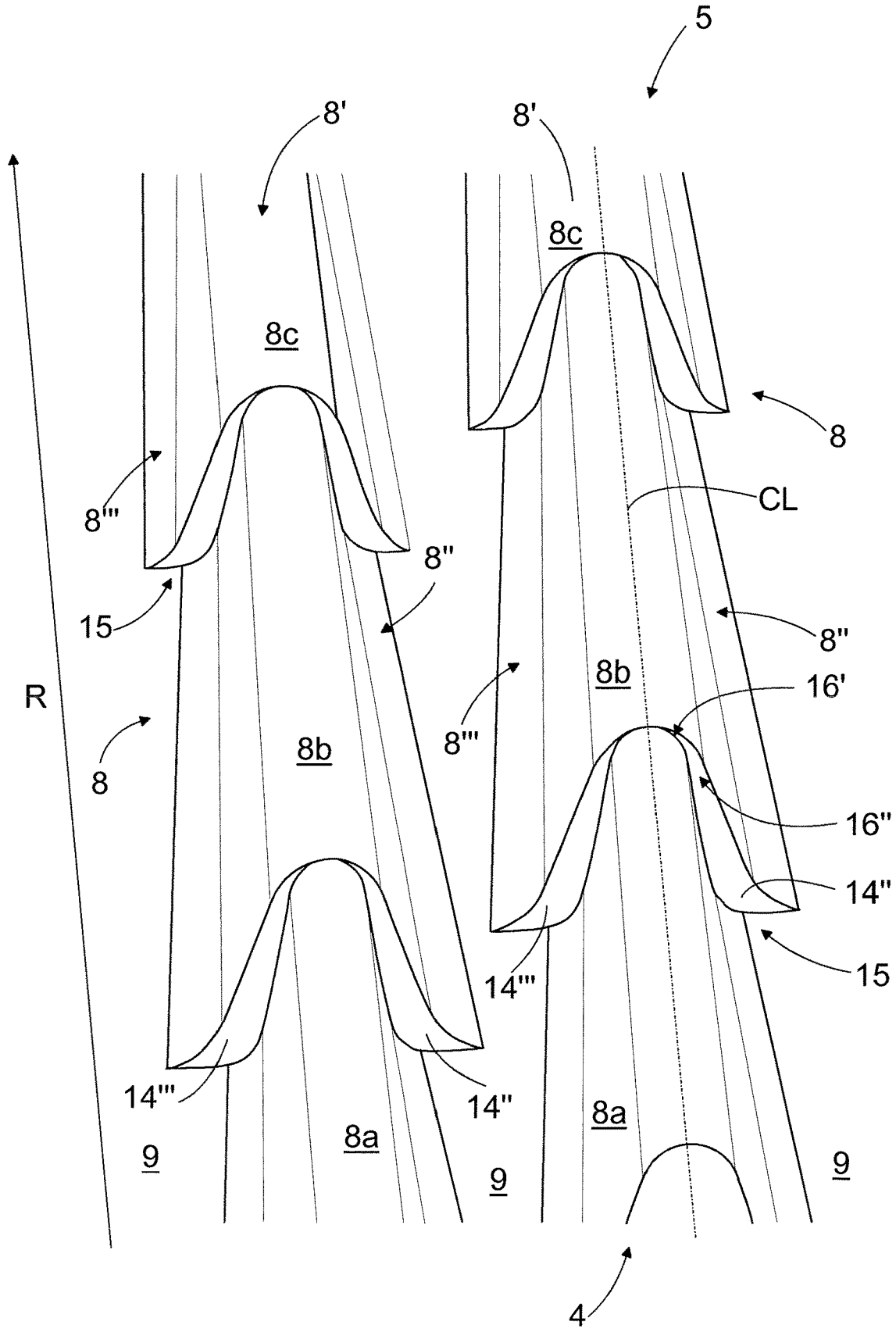
FIG. 2 is a schematic view of an embodiment of some blade bars.

FIG. 2 is a schematic view of an embodiment of some blade bars 8, showing only some portions of the blade bars 8 in the radial direction of the blade element 1. FIG. 3 is a schematic front view of the blade bar 8 of FIG. 2. The blade bars 8 are elongated, extending in a direction away from the inner edge 4 of the blade element 1 and they have generally a top 8', a first side wall 8" or a first flank surface 8" and a second side wall 8'" or a second flank surface 8'". If an intended rotation direction of the blade element 1 of FIG. 1 is to the right, the first side wall 8" provides a leading side of the blade bar 8 and the second side wall 8'" provides a trailing side 8'" of the blade bar 8, whereby the blade bars 10 remaining in the refining zone 13, as being curved forward, provide an effect that restrains the flow of the material to be refined toward the outer edge 5 of the blade element 1. However, if the intended rotation direction of the blade element 1 of FIG. 1 is to the left, the first side wall 8" provides the trailing side of the blade bar 8 and the second side wall 8'" provides the leading side 8'" of the blade bar 8, whereby the blade bars 10 remaining in the refining zone 13, as being curved backward, provide an effect that enhances the flow of the material to be refined toward the outer edge 5 of the blade element 1.

The blade bars 8 are formed of successive, interconnected blade bar parts 8*a*, 8*b*, 8*c*, each blade bar part 8*a*, 8*b*, 8*c* providing a portion of the complete blade bar 8. At an interconnecting point 15 of the successive blade bar parts 8*a*, 8*b*; 8*b*, 8*c* there are abrupt enlargements on both of the side walls 8", 8'" of the blade bar 8, that is a first step 14" on the first side wall 8" of the blade bar 8 and a second step 14'" on the second side wall 8'" of the blade bar 8. In other words, the steps 14", 14'" are abrupt enlargements of the blade bar 8 and the steps 14", 14'" are arranged to extend to at least partly transversal direction relative to the side walls 8", 8'" of the blade bar 8 like wings. The steps 14", 14'" are in a substantially same position in a longitudinal direction of the blade bar 8, i.e. they lie in the blade bar 8 substantially on the same radial level or radial position from the inner edge 4 of the blade element 1 toward the outer edge 5 of the blade element 1. With that definition it is meant that there may be a difference of maximum 20% of a length of the blade bar part 8*a*, 8*b*, 8*c* between mutual positions of the steps 14", 14'" in the longitudinal direction of the blade bar 8. The steps 14", 14'" extend to a direction, that is at least partly transversal to a longitudinal direction of the blade bar 8 such that the steps 14", 14'" extend or are directed away from one another, or in other words, the steps 14", 14'" are directed outwards from both of the side walls 8", 8'" of the blade bar 8. In the embodiment of FIG. 2 the steps 14", 14'" form a right angle with an imaginary center line CL of the blade bar 8 and the steps 14", 14'" are arranged to extend to at least partly transversal direction relative to the longitudinal direction of the side walls 14", 14'" of the blade bar 8. However, a value of the angle between the imaginary center line CL of the blade bar 8 and the steps 14", 14'" may vary to the extent that the steps 14", 14'" are at least partly transversal to the longitudinal direction of the side walls 8", 8'" of the blade bar 8. In the height direction of the blade bar 8 the steps 14", 14'" extend from the bottom of the blade groove 9 preferably up to the top 8' of the blade bar 8.

An advantage of the blade element 1 being provided with blade bars 8 having the steps 14", 14'" on both side walls 8", 8'" of the blade bars 8 is that the rotatable refining element of the refiner provided with the blade element 1 comprising blade bars 8 as disclosed may be rotated into both directions, whereas in prior art solutions, such as in the embodiments disclosed in WO-publication 2004/110628, the blade bar configuration predetermines the intended rotation direction of the rotatable refining element.

In the embodiment of FIG. 2 the successive interconnected blade bar parts 8*a*, 8*b*; 8*b*, 8*c* are straight so that the imaginary center line CL of the blade bar 8 provides an imaginary center line for each blade bar part 8*a*, 8*b*, 8*c*, the imaginary center lines of the successive blade bar parts 8*a*, 8*b*; 8*b*, 8*c* thus being congruent. Furthermore, in the embodiment of FIG. 2 the steps 14", 14'" are mirror images relative to the imaginary center line CL of the blade bar 8, i.e. the dimensioning of the steps 14", 14'" are substantially corresponding. This provides an advantage that the effect of the blade bars 8 to the fibrous material to be processed is the same irrespective of the intended rotation direction. In other words, in this case performance or working of the blade element is independent of the intended rotation direction of the rotatable refining element relative to the blade element 1 provided with the blade bars 8 disclosed above.

In the embodiment of FIG. 2 the steps 14", 14'" are provided by arranging a width of the successive blade bar parts 8*a*, 8*b*; 8*b*, 8*c* to decrease in the longitudinal direction of the blade bar 8, i.e. in a direction from the inner edge 4 of the blade element 1 toward the outer edge 5, i.e in a direction of the radius R of the blade element 1. The blade bar parts 8*a*, 8*b*, 8*c* are thus wedge-shaped in such a way that the width of the preceding blade bar part 8*a*, 8*b*, 8*c* is arranged to decrease toward the successive blade bar part 8*a*, 8*b*, 8*c* in a longitudinal direction of the blade bar 8, i.e. in the direction from the inner edge of the blade element toward the outer edge of the blade element. Each blade bar part 8*a*, 8*b*, 8*c* with its steps or wings 14", 14'" thus resembles an arrow which has a cut tip, the interconnecting point 15, pointing toward the outer edge 5 of the blade element 1. The blade bar 8 comprises a series of such arrows running in succession one after the other. Thereby, as seen in the direction from the inner edge 4 of the blade element 1 toward the outer edge 5, the width of a preceding blade bar part 8*a* at a back end thereof, i.e. at the end of the blade bar part 8*a* facing toward the outer edge 5 and referred to with a reference sign 16', is smaller than the width of a following blade bar part 8*b* at a front end thereof, i.e. at the end of the successive blade bar part 8*b* facing toward the inner edge 4 and referred to with a reference sign 16". Decreasing width of the blade bar parts 8*a*, 8*b*, 8*c* has the benefit of providing guiding surfaces 8", 8'" which force the material toward the step 14", 14'" which in turn forces the material to proceed to the blade gab between the blade bars 8 of the opposing refining elements.

The length of the individual blade bar part 8*a*, 8*b*, 8*c* in the blade bar 8, i.e. the density of the stepping or the steps 14*a*", 14*a*'", in the direction from the inner edge 4 of the blade element 1 toward the outer edge 5, may for example be 5-65 mm, preferably 20-40 mm.

According to an embodiment of the blade bar 8 of FIG. 2, the steps 14", 14'" are tilted toward the outer edge 5 of the blade element 1 such that the steps 14", 14'" provide bevels or inclined surfaces, that enhance the rise of the fibrous material to be defibrated and refined from the bottom of the blade grooves 9 toward the tops 8' of the blade bars 8. The angle of the steps 14", 14'" in respect of the bottom of the blade groove 9, or in respect of the blade element body 2, may for example be 20-70 degrees, preferably 30-45 degrees. With the beveled steps 14", 14'" it is possible to replace dams that are traditionally located at bottoms of the blade grooves between neighboring blade bars. The removal of the dams reduces a tendency of the blade grooves becoming clogged of the material to be refined.

Furthermore, in the embodiment of the blade bar 8 of FIGS. 2 and 3 tops of the blade bar parts 8*a*, 8*b*, 8*c* are rounded, whereby the top 8' of the complete blade bar 8 is rounded so that there are no sharp edges at a top part of the blade bar 8.

According to an embodiment of a blade bar or a part thereof, a cross sectional profile of a top of the blade bar or the part thereof in a direction perpendicular to the longitudinal direction of the blade bar or the part thereof comprises only a number of curved portions each having a radius of curvature. In this embodiment, the top of the blade bar or the part thereof may thus comprise in the direction perpendicular to the longitudinal direction of the blade bar or the part thereof only one curved portion or several curved portions with possibly different radius of curvatures. In this embodiment the top of the blade bar or the part thereof thus comprises no sharp side edges but the blade bar or the part thereof may comprise some sharp side edges lower in the side walls of the blade bar, i.e. closer to the bottoms of the blade grooves, whereby the side walls of the blade bar of the part thereof may comprise flat surfaces, which may be beveled or inclined.

According to an embodiment of a blade bar or a part thereof, a cross sectional profile of the top of the blade bar or the part thereof in a direction perpendicular to the longitudinal direction of the blade bar comprises only a single curved portion having a single radius of curvature. In this embodiment, the top of the blade bar or the part thereof thus comprises in the direction perpendicular to the longitudinal direction of the blade bar or the part thereof only one curved portion. In this embodiment the top of the blade bar of the part thereof thus comprises no sharp side edges but the blade bar or the part thereof may comprise some sharp side edges lower in the side walls of the blade bar or the part thereof, i.e. closer to the bottoms of the blade grooves, whereby the sides of the blade bar or the part thereof may comprise flat surfaces, which may be beveled or inclined.

According to an embodiment, a blade bar or a part thereof is rounded such that a cross sectional profile of the blade bar or the part thereof in a direction perpendicular to the longitudinal direction of the blade bar or the part thereof comprises only a single or multiple curved portions each having a radius of curvature. In this embodiment, the cross sectional profile of the whole blade bar or the part thereof comprises either one curved portion or several curved portions with possibly different radius of curvatures in the direction perpendicular to the longitudinal direction of the blade bar or the part thereof but does not at all comprise any sharp side edges, whereby the side walls of the blade bar does not comprise any flat surfaces. The embodiment of the blade bar 8 and the parts 8*a*, 8*b*, 8*c* thereof shown in FIGS. 2 and 3 is a blade bar comprising several curved portions in the direction perpendicular to the longitudinal direction of the blade bar 8. In FIG. 3 there are shown arrows denoted by reference signs R1, R2, R3, R4 and R5 that indicate very schematically the curved portions and the radius of curvatures of the curved portions in the blade bar 8 in the direction perpendicular to the longitudinal direction thereof, R1 indicating the curved portion in the top 8' of the blade bar 8 and R2, R3, R4, R5 indicating the curves portions in the side walls of the blade bar 8.

The blade bars 8 or the parts 8*a*, 8*b*, 8*c* thereof having the rounded tops 8' lie preferably only in the defibration zone 12 of the blade element 1 but may in some blade bar configurations extend also into the refining zone 13 of the blade element 1.

Because of the rounded top 8' of the blade bar 8 or the part 8*a*, 8*b*, 8*c* thereof in the defibration zone 12 a risk of fibrillation and fiber shortening effect on the refined material is reduced in the defibration zone 12 of the blade gap. In other words, the rounded tops 8' or top surfaces of the blade bars 8 or the parts 8*a*, 8*b*, 8*c* thereof in the defibration zone 12 provide on the material, i.e. wood chips, an effect which crushes the wood chips into smaller pieces and individual fibers but does not substantially increase fibrillation degree of the fibers or decrease fiber length, which takes place in traditional blade elements comprising traditional blade bars with sharp edges in the top of the blade bars. In the embodiment of FIG. 1, the fibrillation and fiber shortening then takes place substantially only in the refining zone 13 comprising the blade bars 10 if tops of them are provided with sharp edges.

Figure 4:
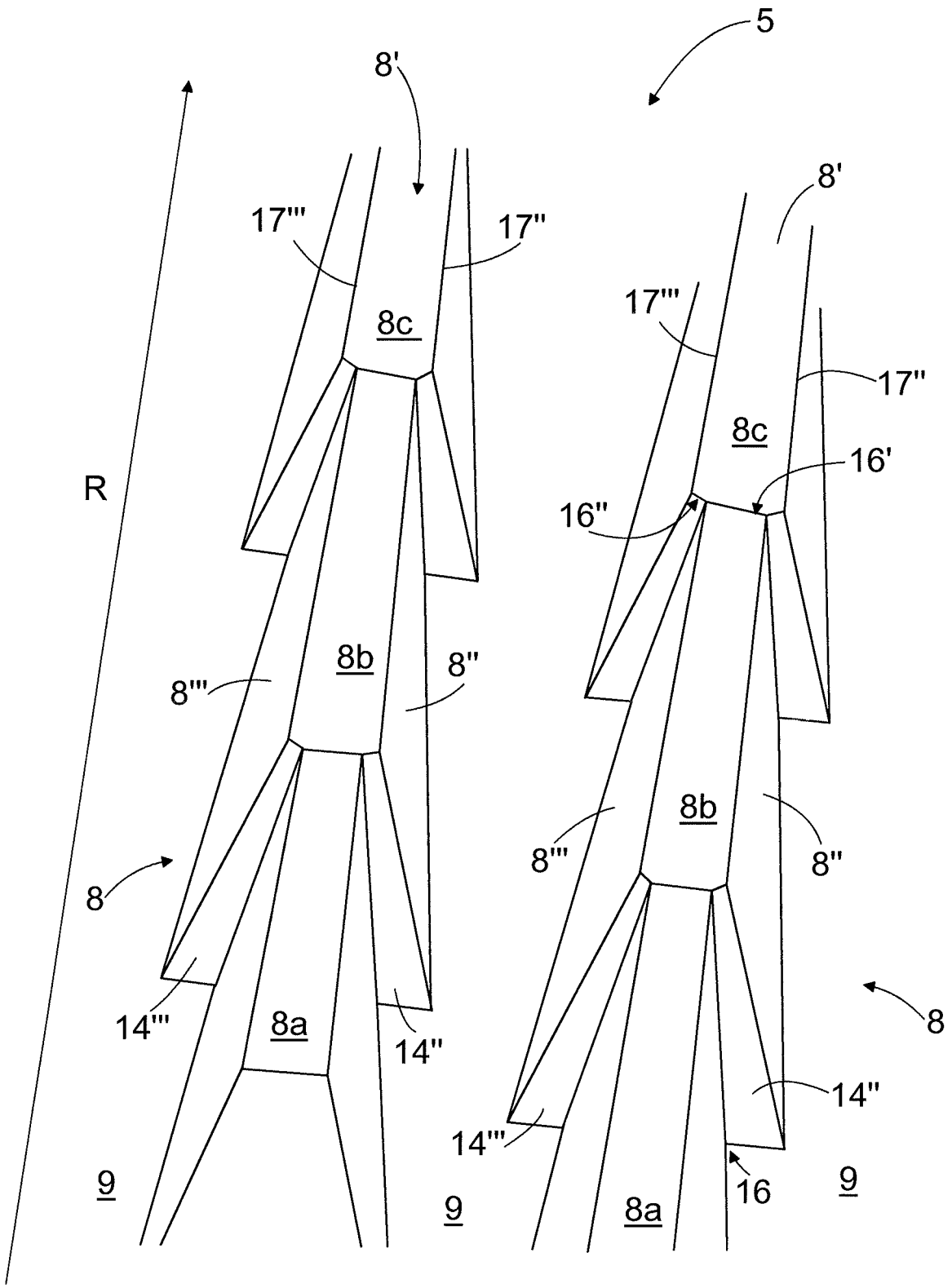
FIG. 4 is a schematic view of an embodiment of some other blade bars.

FIG. 4 is a schematic view of second blade bars 8, showing only some portions of the blade bars 8 in the radial direction of the blade element 1. The blade bars 8 of FIG. 4 are otherwise similar to those of FIG. 2 but the blade bars 8 of FIG. 4 have planar top surfaces 8', whereby the blade bars 8 of FIG. 4 comprise sharp side edges 17", 17'" between the planar top surface 8' and the side walls 8", 8'".

The blade bars 8 of FIG. 4 may be utilized in the defibration zone 12 if it is intended to provide fibrillation and fiber shortening effect on the material to be refined already in the defibration zone 12. Alternatively the blade bars 8 of FIG. 4 comprising the sharp side edges 17", 17'" may be utilized in the refining zone 13 wherein the fibrillation and the fiber shortening effect is intended to take place.

Although the benefits of the invention could be partly achieved if only a few of the blade bars 8 of the blade element 1 have the shape of the invention, it is preferable that at least 20%, and more preferably at least 50% of the blade bars 8 are equipped with steps 14", 14'" on both their side walls according to the invention. It is preferable also that substantially all the blade bars 8 of the blade element 1 have the shape of the invention. More preferably substantially all the blade bars 8 at least in the defibration zone 12 have the shape of the invention. According to an embodiment at least one blade bar 8 has the shape of the invention.

The steps 14", 14'" of two neighboring blade bars 8 can lie on the same radial level but preferably there is a radial shift between neighboring steps 14", 14'" in a blade groove 9 so that the first step 14" of one blade bar 8 lies radially on a higher or lower level than the second step 14'" in its neighboring blade bar 8, i.e. in the blade bar 8 on the opposite side of the same blade groove 9. Then the shape of the blade groove 9 is even more irregular with multiple edges and multifaceted walls which may further improve chip guidance to the blade gab. The radial shift could be for example of 20-50% of the length of a blade bar part 8*a*, 8*b*, 8*c*.

Figure 5:
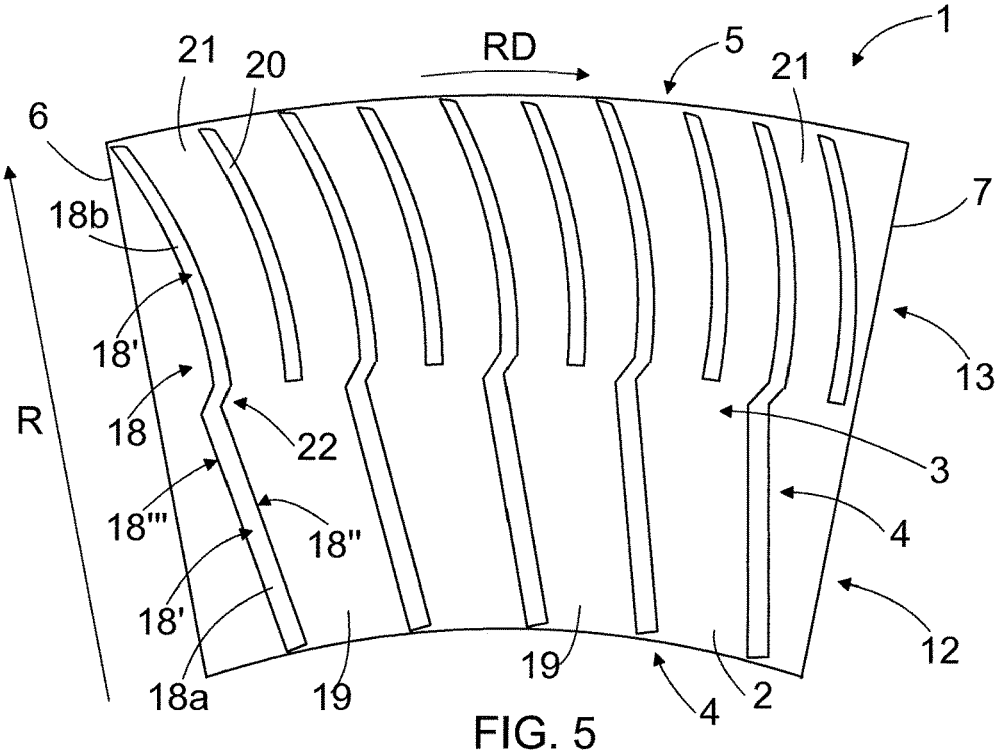
FIG. 5 is a schematic general upper view of another blade element.

FIG. 5 is a schematic general upper view of another blade element 1. The blade element 1 of FIG. 5 is a blade segment intended to provide a part of a disc-like refining surface of a refining element in a disc refiner which is intended for refining fibrous material, such as wood material. The blade element 1 of FIG. 5 comprises a blade element body 2 and a refining surface 3 on an upper surface thereof. The blade element 1 comprises an inner edge 4 or a feed edge 4 or an inner periphery 4 which is directed toward a center of the disc refiner and through which the material to be refined may be fed into a blade gap between opposing refining elements. The blade element 1 further comprises an outer edge 5 or a discharge edge 5 or an outer periphery 5 through which the material already refined in the blade gap between the opposing refining elements may be discharged out of the blade gap, as well as a first side edge 6 and a second side edge 7 providing the side edges of the blade element 1 of FIG. 5.

The refining surface 3 of the blade element 1 of FIG. 5 is provided with first blade bars 18 which are elongated and continuous over substantially a whole length of the refining surface radius R, i.e. the first blade bars 18 extend in a direction from the inner edge 4 of the blade element 1 toward the outer edge 5 of the blade element 1, substantially up to the outer edge 5. Next to the inner edge 4 there are first blade grooves 19 between the first blade bars 18.

Furthermore, next to the outer edge 5 of the blade element 1 the blade element 1 is provided with second blade bars 20 between the first blade bars 18. Next to the outer edge 5 of the blade element 1 there are second blade grooves 21 between the first blade bars 18 and the second blade bars 20.

The blade element 1 of FIG. 5 is a blade segment intended to provide a part of a refining surface of a rotatable refining element, i.e. a rotor of a refiner, whereby a complete refining surface of the rotatable refining element is made by attaching a number of the blade elements 1 of FIG. 5 next to each other. An intended rotation direction of the rotatable refining element is shown with an arrow denoted with a reference sign RD. A blade element, that is a mirror image in respect of a radius R of the blade element 1, the radius being shown with an arrow denoted with a reference sign R, may be used to provide a part of a refining surface of an opposing refining element in the refiner, which may also be a rotatable refining element but rotating into an opposing direction, or a stationary refining element, i.e. a stator, of the refiner.

The blade bars 18 of FIG. 5 are elongated and continuous over substantially a whole length of the refining surface radius R and they have generally a top 18', a leading side 18" or a first side wall 18" or a first flank surface 18" facing toward the intended rotation direction RD and a trailing side 18'" or a second side wall 18" or a second flank surface 18'" facing into opposite direction in respect of the intended rotation direction RD. The blade bars 18 are formed of two successive, interconnected blade bar parts 18*a*, 18*b*, i.e. the first blade bar part 18*a* on the side of the inner edge 4 of the blade element 1 and the second blade bar part 18*b* on the side of the outer edge 5 of the blade element 1, whereby the first blade bar part 18*a* provides a first portion of the complete blade bar 18 and the second blade bar part 18*b* provides a second portion of the complete blade bar 18. Between the blade bar parts 18*a*, 18*b* there is a step 22 or a displacement 22 directed or extending toward the intended rotation direction RD such that a portion of the second blade bar part 18*b* extends farther toward the intended rotation direction RD than a portion of the first blade bar part 18*a*, meaning also that there is a shift in the intended rotation direction RD between imaginary center lines of the blade bar parts 18*a*, 18*b*, i.e. the center lines of the blade bar parts 18*a*, 18*b* are not congruent. In some blade bar configurations the step 22 could also be directed into opposite direction, i.e. in the direction being opposite to the intended rotation direction RD.

The first blade bar parts 18*a* together with the blade grooves 19 therebetween form a substantially sparse blade bar configuration providing a defibration zone 12 intended to disintegrate woods chips fed into the refiner to individual fibers with a minimum of fiber shortening. The second blade bar parts 18*b* together with the blade bars 20 and the blade grooves 21 therebetween on the side of the outer edge 5 of the blade element 1 form a substantially dense blade bar configuration providing a refining zone 13 intended to refine the material to be processed, i.e. the fibrillation and fiber shortening of the material to be processed is intended to take place at this part of the blade element 1. Generally, a blade element and blade bars and blade grooves therein may be intended to provide a part of only a single zone in refining elements having multiple radial zones, whereby the refining element may comprise several neighboring blade elements both in a direction of the radius and in a peripheral direction of the refining element. In that case the defibration zone 12 and the refining zone 13 could lie on separate blade elements so that the defibration zone 12 alone could provide a radially inner element and, respectively, the refining zone 13 could form a radially outer element.

Figure 6:
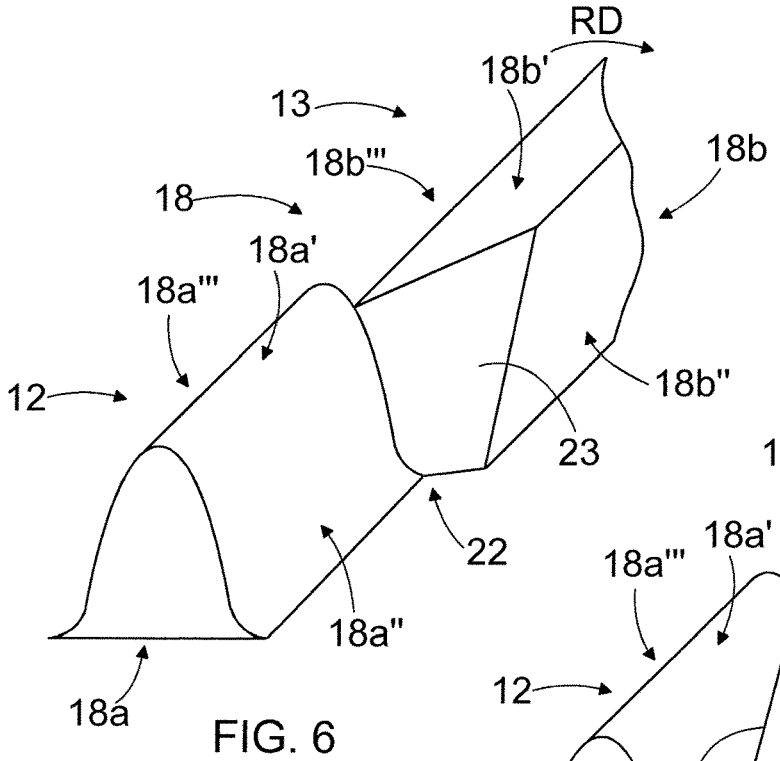
FIG. 6 is a schematic view of a first embodiment of a blade bar in the blade element of FIG. 5.
Figure 7:
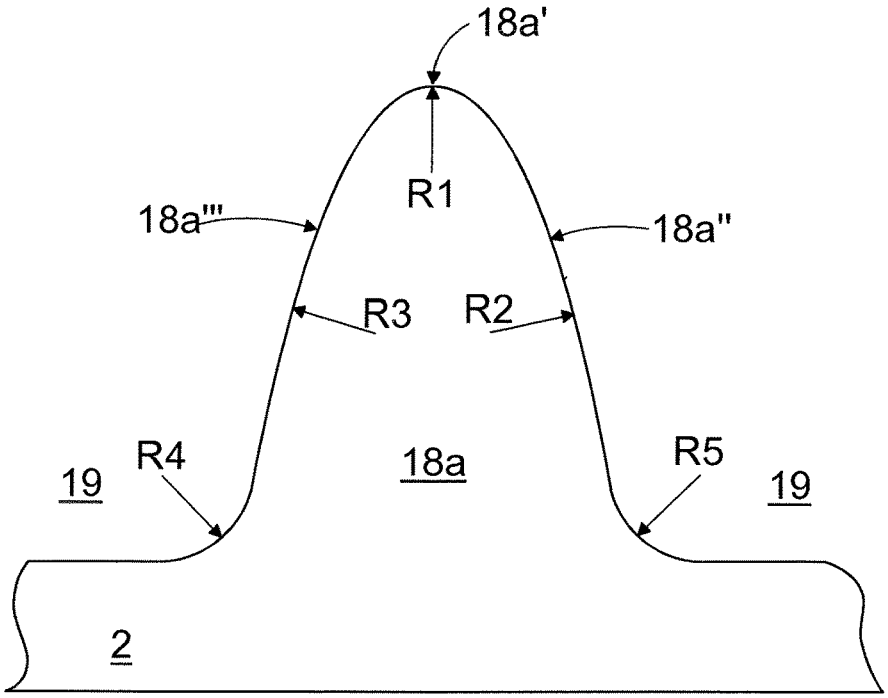
FIG. 7 is a schematic front view of a part of the blade bar of FIG. 6.

FIG. 6 is a schematic view of a blade bar 18 comprising the first blade bar part 18*a* remaining in the defibration zone 12 of the blade element 1 and the second blade bar part 18*b* remaining in the refining zone 13 of the blade element 1 of FIG. 5. FIG. 7 is a schematic front view of the first blade bar part 18*a* of the blade bar 4 of FIG. 6. The first blade bar part 18*a* has a top 18*a'* providing a top surface of the first blade bar part 18*a*, a leading side 18*a"* or a leading side wall 18*a"* facing toward the intended rotation direction RD and a trailing side 18*a'"* or a trailing side wall 18*a'"* facing into opposite direction in respect of the intended rotation direction RD. The second blade bar part 18*b* has correspondingly a top 18*b'*, a leading side 18*b"* or a leading side wall 18*b"* and a trailing side 18*b'"* or a trailing side wall 18*b'*.

A top 18*a'* of the first blade bar part 18*a* is rounded so that there are no sharp edges at a top part of the first blade bar part 18*a*, meaning that the top surface of the first blade bar part 18*a* is rounded. A top 18*b'* of the second blade bar part 18*b* is, in turn, substantially planar and has sharp edges between the top surface 18*b'* of the second blade bar part 18*b* and sides 18*b"*, 18*b'"* thereof.

The rounded top 18*a'* of the first blade bar part 18*a* in the defibration zone 12 provides on the wood chips to be fed into the defibration zone 12 in the blade gap between the opposing refining elements a defibration effect which reduces a risk of fibrillation and fiber shortening in the defibration zone 12. In other words, the rounded tops 18*a'* or top surfaces of the first blade bar parts 18*a* in the defibration zone 12 provides on the material, i.e. wood chips, an effect which crushes the wood chips into smaller pieces and into individual fibers but does not substantially increase fibrillation degree of the fibers or decrease fiber length, which takes place in traditional blade elements comprising traditional blade bars with sharp edges in the top of the blade bars. In the embodiment of FIG. 6, the fibrillation and fiber shortening thus takes place substantially only in the refining zone 13 comprising the second blade bar parts 18*b* a top 18*b*' of which is provided with sharp edges. In FIG. 6 there is also shown a bevel 23 in the end of the second blade bar part 4*b* at the connecting point of the first 18*a* and second 18*b* blade bar parts, or in other words, at the leading side 18" of the blade bar 18. The bevel 23 is intended to promote a rise of the material to be refined from the blade groove 19 toward the top 18*b*' of the second blade bar part 18*b* and thereby between the opposing blade bars in the refining zone 13 in the blade gap between the opposing refining elements.

According to an embodiment of the blade element disclosed in FIG. 5, a cross sectional profile of a top of a longitudinal portion of the at least one blade bar comprises, in a direction perpendicular to the longitudinal direction of the blade bar, only a number of curved portions each having a radius of curvature. In this embodiment, the top of the blade bar may thus comprise in the direction perpendicular to the longitudinal direction of the blade bar only one curved portion or several curved portions with possibly different radius of curvatures. In this embodiment the top of the blade bar thus comprises no sharp edges but there could be some sharp edges lower in the sides of the blade bar, i.e. closer to a bottom of the blade grooves, whereby the sides of the blade bar may comprise planar or flat surfaces.

According to an embodiment of the blade element disclosed in FIG. 5, a cross sectional profile of a top of a longitudinal portion of the at least one blade bar comprises, in a direction perpendicular to the longitudinal direction of the blade bar, only a single curved portion having a single radius of curvature. In this embodiment, the top of the blade bar thus comprises in the direction perpendicular to the longitudinal direction of the blade bar only one curved portion. In this embodiment the top of the blade bar thus comprises no sharp edges but there could be some sharp edges lower in the sides of the blade bar, i.e. closer to a bottom of the blade grooves, whereby the sides of the blade bar may comprise planar or flat surfaces.

According to an embodiment of the blade element disclosed in FIG. 5, a longitudinal portion of at least one blade bar is rounded such that a cross sectional profile of the longitudinal portion of the blade bar in a direction perpendicular to the longitudinal direction of the blade bar comprises only a single or multiple curved portions each having a radius of curvature. In this embodiment, the cross sectional profile of the whole blade bar comprises either one curved portion or several curved portions with possibly different radius of curvatures in the direction perpendicular to the longitudinal direction of the blade bar but does not at all comprise any sharp edges, whereby the sides of the blade bar does not comprise any planar or flat surfaces. The embodiment of the first blade bar part 18*a* in FIGS. 6 and 7 is a blade bar portion comprising several curved portions in the direction perpendicular to the longitudinal direction of the blade bar 18. In FIG. 7 there are shown arrows denoted by reference signs R1, R2, R3, R4 and R5 that indicate very schematically the curved portions and the radius of curvatures of the curved portions in the blade bar part 18*a* in the direction perpendicular to the longitudinal direction thereof. R1 indicates the curved portion in the top 18*a*' of the first blade bar part 18*a* and R2, R3, R4, R5 indicate the curves portions in the sides of the first blade bar part 18*a*.

Figure 8:
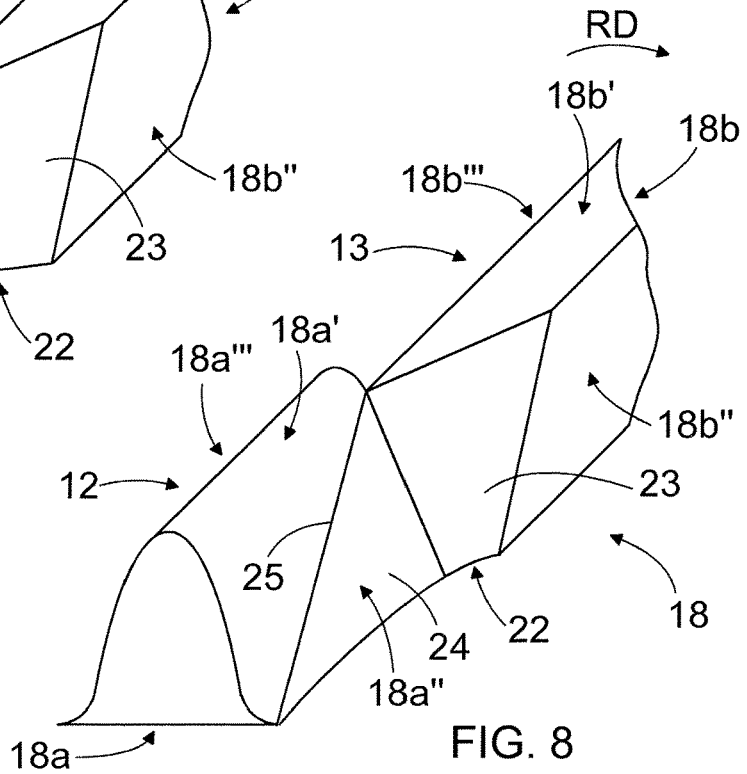
FIG. 8 is a schematic view of a second embodiment of a blade bar in the blade element of FIG. 5.

FIG. 8 is a schematic view of an embodiment of the blade bar 18 that is substantially similar to that of FIG. 6 but additionally disclosing a bevel 24 in the leading side 18*a*" of the first blade bar part 18*a* that has the rounded top surface 18*a*'. The inclusion of the bevel 24 in the leading side 18*a*" of the first blade bar part 18*a* thus provides a sharp edge 25 in the leading side 18*a*" of the first blade bar part 18*a*. The bevel 24 promotes a rise of the wood chips to be disintegrated from the bottom of the blade groove 19 toward the top of the first blade bar part 18*a* and thereby between the opposing blade bars in the blade gap between the opposing refining elements. The sharp edge 25 does not, however, have any effect on the defibration because it does not extend up to the top 18*a*' of the first blade bar part 18*a* wherein the blade bars in the opposing refining elements bypass each other.

According to an embodiment, the width of the first blade bar parts 18*a* in the defibration zone 12 may be 5.4-6.0 mm. In that case, if the cross sectional profile of the top of the first blade bar part 18*a* comprises only one curved portion, the radius of the curved portion may be 2.7-3.0 mm. The width of the blade grooves 19 in the defibration zone 12 may, in turn, be for example 15.0 mm. The width of the second blade bar parts 18*b* in the refining zone 13 may for example be 3.4-4.2 mm and the width of the blade grooves 21 in the refining zone 13 may for example be 7.7 mm. The width of the first 18*a* and second 18*b* blade bar parts as well as the width of the blade grooves 19, 21 may change in the longitudinal direction thereof.

Basically blade bars comprising portions with rounded tops may be located at any part of the refining surface 3 of the blade element 1 of FIG. 5 but preferably they are located in the defibration zone 12, as explained above. It is preferable that substantially all or at least most of the blade bars 18 or parts thereof in the defibration zone 12 are rounded. The first blade bar parts 18*a* and the second blade bar parts 18*b* could also be separate blade bars without any connecting point therebetween, whereby the first blade bar parts 18*a* would provide blade bars with rounded tops and being located only in the defibration zone 12 and the second blade bar parts 18*b* would provide blade bars with planar tops and being located only in the refining zone 13. It is also possible that the blade bar 18 comprising the first blade bar part 18*a* and the second blade bar part 18*b* is located in its entirety in the area of the defibration zone 12 only, whereby the top 18*b*' of the second blade bar part 18*b* may be either rounded or flat, the rounded top being more preferable. Furthermore, it is also possible that only a portion of a complete blade bar with only one part in the longitudinal direction thereof comprises the rounded top, the rest of the same blade bar having a conventional planar top with sharp edges.

Figure 9:
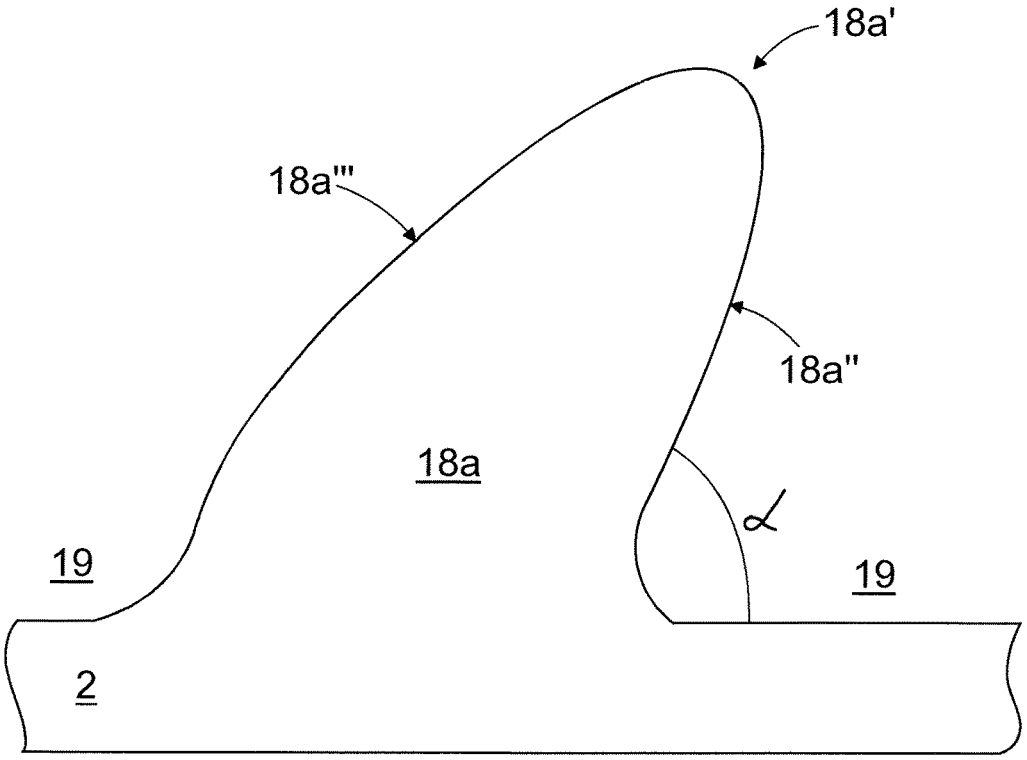
FIG. 9 is a schematic front view of a part of a third blade bar.

FIG. 9 is a schematic front view of an embodiment of a first blade bar part 18*a* of a blade bar 18. The embodiment of the first blade bar part 18*a* in FIG. 9 also comprises several curved portions in the direction perpendicular to the longitudinal direction of the blade bar 18. The leading side 18*a*" of the first blade bar part 18*a* in FIG. 9 is, however, tilted or leaning toward the intended rotation direction RD such that an angle of tilt $\alpha$ between the bottom of the neighbouring blade groove 19, or the blade element body 2, and at least a portion of the leading side 18*a*" of the first blade bar part 18*a* is an acute angle, i.e. less than 90 degrees. The tilting of the first blade bar part 18*a* as disclosed prevents the wood chips to be fed into the refiner from rising toward the top of the first blade bar part 18*a*, thus delimiting the amount of wood chips entering into the blade gap between the opposing refining elements, thus preventing the blade gap of the refiner becoming clogged at the defibration zone 12.

According to an embodiment of the blade element 1 of FIG. 5, the blade bar part 18*a* shown in FIGS. 5, 6, 7, 8, 9 may be replaced with a blade bar 8 comprising a number of successive blade bar parts 8*a*, 8*b*, 8*c* as disclosed in FIGS. 2, 3 and 4 and the related description. In this embodiment the blade bar part 18*a* comprises a number of successive blade bar parts 8*a*, 8*b*, 8*c* having rounded tops 8' and at connecting points between the successive first blade bar parts 8*a*, 8*b*; 8*b*, 8*c* there is an abrupt enlargement or a step 14", 14" on both sides of the blade bar, that is a step 14" on the leading sides of the blade bar parts 18*a* and a step 14'" on the trailing sides of the first blade bar parts 18*a*, wherein the features of the steps may be as disclosed in FIGS. 2, 3 and 4 and the related description.

According to an embodiment of a blade element 1 of FIG. 5 for a refiner for refining fibrous material, the blade element 1 comprises a refining surface 3 provided with blade bars 18, 20 and blade grooves 19, 21 therebetween, wherein at least one blade bar 18, 18*a* comprises a longitudinal portion a top 18', 18*a'* of which is rounded.

According to an embodiment of a blade element 1 of FIG. 5, a cross sectional profile of the top 18', 18*a"* of the longitudinal portion of the at least one blade bar 18, 18*a* comprises in a direction perpendicular to the longitudinal direction of the blade bar 18, 18*a* only a number of curved portions R1, R2, R3, R4, R5 each having a radius of curvature R1, R2, R3, R4, R5.

According to an embodiment of a blade element 1 of FIG. 5, a cross sectional profile of the top 18', 18*a'* of the longitudinal portion of the at least one blade bar 18, 18*a* comprises in the direction perpendicular to the longitudinal direction of the blade bar 18, 18*a* only a single curved portion R1 having a single radius of curvature R1.

According to an embodiment of a blade element 1 of FIG. 5, a top 18', 18*a'* of at least one complete blade bar 18, 18*a* is rounded.

According to an embodiment of a blade element 1 of FIG. 5, a longitudinal portion of at least one blade bar 18, 18*a* is rounded such that a cross sectional profile of the longitudinal portion of the at least one blade bar 18, 18*a* in a direction perpendicular to the longitudinal direction of the blade bar comprises only a single R1 or multiple R1, R2, R3, R4, R5 curved portions each having a radius of curvature R1, R2, R3, R4, R5.

According to an embodiment of a blade element 1 of FIG. 5, the blade bar 18 is formed in the longitudinal direction thereof of at least two successive blade bar parts 8*a*, 8*b*, 8*c*, 18*a*, 18*b* connected to each other such that there is a step 14", 14'", 22 at a connecting point of the successive blade bar parts 8*a*, 8*b*, 8*c*, 18*a*, 18*b* in at least one of a leading side of the blade bar part 8*a*, 8*b*, 8*c*, 18*a*, 18*b* and a trailing side 8*a*, 8*b*, 8*c*, 18*a'"*, 18*b'"* of the blade bar part 8*a*, 8*b*, 8*c*, 18*a*, 18*b* and that at least the top 8*a'*, 8*b'*, 18*a'* of at least one preceding blade bar part 8*a*, 8*b*, 18*a* of successive blade bar parts 8*a*, 8*b*, 8*c*, 18*a*, 18*b* is rounded.

According to an embodiment of a blade element 1 of FIG. 5, there is a step 14", 14'" at the connecting point of the successive blade bar parts 8*a*, 8*b*, 8*c*, 18*a*, 18*b* both in the leading side of the blade bar part 8*a*, 8*b*, 8*c*, 18*a*, 18*b* and in the trailing side of the blade bar part 8*a*, 8*b*, 8*c*, 18*a*, 18*b*.

According to an embodiment of a blade element 1 of FIG. 5, the steps 14", 14'" at the connecting point of the successive blade bar parts 8*a*, 8*b*, 8*c*, 18*a*, 18*b* are provided by arranging a width of the preceding blade bar part 8*a*, 8*b*, 8*c*, 18*a* to decrease toward the successive blade bar part 8*b*, 8*c*, 18*b*.

According to an embodiment of a blade element 1 of FIG. 5, the blade element 1 comprises at least one defibration zone 12 and at least one refining zone 13 successive to the at least one defibration zone 12 and that at least the top 8', 18', 18*a'* of the longitudinal portion of the blade bar 8, 18, 18*a* remaining in the at least one defibration zone 12 is rounded.

According to an embodiment of the blade element 1 shown in FIGS. 2, 3 and 4 may also comprise a bevel 24 disclosed in FIG. 8, on at least one of the a first side wall 8' and a second side wall 8" of the blade bar 8 in at least one of the successive blade bar parts 8*a*, 8*b*, 8*c*. The inclusion of the bevel 24 in at least one side wall 8', 8" in at least one of the successive blade bar parts 8*a*, 8*b*, 8*c* thus provides a sharp edge 25 in at least one side wall 8', 8" in at least one of the successive blade bar parts 8*a*, 8*b*, 8*c*. The bevel 24 promotes a rise of the wood chips to be disintegrated from the bottom of the blade groove 9 toward the top of the blade bar part 8*a*, 8*b*, 8*c* thereby between the opposing blade bars in the blade gap between the opposing refining elements. The sharp edge 25 does not, however, have any effect on the defibration because it does not extend up to the top 8' of the blade bar 8 wherein the blade bars in the opposing refining elements bypass each other.

In addition to blade elements intended for the disc refiner, the features of the blade bars as disclosed herein may be utilized as well in blade elements intended to cone refiners and cylindrical refiners. The features of the blade bars as disclosed herein may also be used both in low consistency refiners and in high consistency refiners.

The steps and possibly beveled surfaces therein may be used to replace traditionally used dams at the bottoms of the blade grooves to direct the material to be processed toward the blade gap between the opposing refining elements. The advantage of the steps, with beveled surfaces or without them, over the dams is that the steps do not completely interrupt the open bottom of the blade grooves, whereby a risk of the blade gap becoming clogged may be reduced.

It will be obvious to a person skilled in the art that, as the technology advances, the inventive concept can be implemented in various ways. The invention and its embodiments are not limited to the examples described above but may vary within the scope of the claims.

The invention claimed is:

1. A blade element for a refiner for refining fibrous material, the blade element comprising:

a blade element body having an upper surface;

a refining surface on the upper surface, the refining surface having blade bars extending in a vertical direction and defining blade grooves therebetween, the blade bars extending in a longitudinal direction from an inner edge of the blade element toward an outer edge of the blade element;

wherein the blade element defines a transversal direction perpendicular to the longitudinal direction;

wherein the blade bars have side walls facing away from one another in the transversal direction;

wherein at least one blade bar has at least a first successive blade bar part and a second successive blade bar part which both extend in the longitudinal direction and are connected to each other at a connecting point so that the second successive blade bar part follows the first successive blade bar part in the longitudinal direction;

wherein each blade bar part defines a width in the transversal direction, and wherein the width of each blade bar part is tapered in the longitudinal direction and in the vertical direction;

wherein each blade bar part is tapered toward an imaginary center line of the at least one blade bar in the vertical direction such that side walls of the at least one blade bar slope inwardly and upwardly to a top surface of each blade bar part as they converge in the vertical direction;

wherein each blade bar part is tapered toward the imaginary center line of the at least one blade bar in the longitudinal direction such that side walls of the at least one blade bar converge in the longitudinal direction;

wherein at the connecting point, the first successive blade bar part has a width which because of the longitudinal tapering is narrower than the second successive blade bar part; and wherein the top surface of the first successive blade bar part joins the top surface of the second successive blade bar part at the connection point and wherein the second successive blade bar part forms steps extending at least partly in the transversal direction and on either side of the first successive blade bar part, the steps extending from the upper surface of the blade element body to the top surface of the second successive blade bar part forming a continuous ramp from the upper surface of the blade element body to the top surface of the second successive blade bar so as to direct fibrous material from blade grooves on either side to the top surface of the second successive blade bar part.

2. The blade element of claim 1 wherein the steps of the at second successive blade bar part are located at the same distance ±20% in the longitudinal direction from the inner edge of the blade element.

3. The blade element of claim 1 wherein the first successive blade bar part and the second successive blade bar parts are straight and the imaginary center lines of the first successive blade bar part and the second successive blade bar part are congruent.

4. The blade element of claim 1 wherein the steps are inclined away from the imaginary center line of the at least one blade bar.

5. The blade element of claim 1 wherein at least a part of top surfaces of the at least one blade bar is rounded.

6. The blade element of claim 1 wherein a cross sectional profile of at least a part of top surfaces of the at least one blade bar in the transversal direction has a number of curved portions each having a radius of curvature.

7. The blade element of claim 1 wherein the blade element comprises at least one defibration zone and at least one refining zone successive to the at least one defibration zone in the longitudinal direction and wherein the steps of the second successive blade part are located only in the at least one defibration zone.

8. The blade element of claim 1 wherein at least 20% of the blade bars in a defibration zone of the blade element are equipped with steps.

9. The blade element of claim 1 wherein steps of two neighboring blade bars having a blade groove between them are arranged to lie at the same distance in the longitudinal direction from the inner edge of the blade element.

10. The blade element of claim 1 further comprising two neighboring blade bars having a blade groove between them, and each of the neighboring blade bars have a first step extending to the right in the transversal direction and a second step extending to the left in the transversal direction, the first steps and the second steps, of the respective neighboring blade bars are arranged to lie at different distances from the inner edge of the blade element in the longitudinal direction in such a way that the first step of one of the neighboring blade bars lies at a distance from the inner edge of the blade element in the longitudinal direction which is greater or less than the second step of the other neighboring blade bar.

11. The blade element of claim 1 wherein the first successive blade bar first part and the second successive blade bar part comprise several curved portions in the direction perpendicular to the longitudinal direction of the at least one blade bar.

12. The blade element of claim 1 wherein the first successive blade bar first part and the second successive blade bar part comprise several straight lines in the form of a trapezoid in the direction perpendicular to the longitudinal direction of the at least one blade bar.

13. The blade element of claim 1 wherein the blade bars comprise first blade bars which form a defibration zone and wherein the imaginary center lines of each of the first blade bars are straight lines and wherein the blade element has second blade bars and second grooves therebetween which are formed on the blade element after the first blade bars in the longitudinal direction toward the outer edge and which form a refining zone, and wherein the second blade bars are curved as they extend toward the outer edge of the blade element so that depending on an intended direction of rotation of the blade element the second blade bars provide an effect that either enhances flow of the fibrous material toward the outer edge or restrains flow of the fibrous material toward the outer edge.

* * * * *